United States Patent [19]

Hulin

[11] Patent Number: 4,464,561

[45] Date of Patent: Aug. 7, 1984

[54] DEVELOPMENT UNIT FOR DRY SILVER RECORDING PAPER

[75] Inventor: David K. Hulin, Bramley, England

[73] Assignee: Medellec Limited, London, England

[21] Appl. No.: 354,349

[22] Filed: Mar. 3, 1982

[30] Foreign Application Priority Data

Mar. 3, 1981 [GB] United Kingdom ..... 8106679

[51] Int. Cl.[3] ..... H05B 1/00

[52] U.S. Cl. ..... 219/216; 219/388; 432/230

[58] Field of Search ..... 219/216, 388; 354/299; 432/227, 230, 231, 59

[56] References Cited

U.S. PATENT DOCUMENTS

| | | | |
|---|---|---|---|
| 3,876,860 | 4/1975 | Nomura | 219/388 |
| 4,266,115 | 5/1981 | Dannatt | 219/216 |
| 4,275,959 | 6/1981 | Jones | 219/388 |
| 4,304,985 | 12/1981 | Miller | 219/388 |

*Primary Examiner*—Roy N. Envall, Jr.
*Assistant Examiner*—Teresa J. Walberg
*Attorney, Agent, or Firm*—Armstrong, Nikaido, Marmelstein & Kubovcik

[57] ABSTRACT

A developer unit for dry silver recording paper is disclosed. The unit comprises a thermally conductive foil (1) which preferably is arcuate in configuration. The foil makes contact (6) with a thermally conductive strip (5). At least one heating element, and preferably two heating assemblies (*7a* and *7b*) are provided in thermal contact with the strip (5). Temperature control means (FIG. 4) is preferably provided to ensure accurate maintenance of the temperature applied to the recording paper via heating assemblies (*7a* and *7b*), strip (5) and foil (1).

A developer unit of the above type enables a very large paper speed variation to be achieved with a fixed foil length of relatively modest dimensions.

14 Claims, 4 Drawing Figures

DEVELOPMENT UNIT FOR DRY SILVER RECORDING PAPER

BACKGROUND OF THE INVENTION

Dry silver recording paper is used in a number of analytical and recording instruments which, in general, include an arrangement for developing the recording paper as it leaves the apparatus. Dry silver recording material is developed by heat. Conventionally, the exposed paper is passed over a heated platen. The development process must be controlled within certain limits, since if the recording material is overheated due either to excess temperature or inadequate transport speed, discoloration of the recording results while if the material is underheated, contrast in the developed image is reduced. It is therefore necessary to adjust the development conditions if the rate of transport of the recording paper through the recording equipment is to be varied. This normally involves either changing the length of platen over which the recording paper moves, or changing the temperature of the platen.

Particular problems are involved if the recording paper is transported at a very slow speed. Since a minimum temperature must be achieved in order to provide satisfactory development, only a short platen can be used. The present invention aims to provide a development unit for developing dry silver recording paper which unit can be used over a relatively wide range of paper speeds including very slow speeds.

SUMMARY OF THE INVENTION

According to the present invention, there is provided a developer unit for dry silver recording paper, which comprises a thin foil of thermally conductive material over the top surface of which the recording paper is passed; and a thermally conductive strip provided with at least one heating element, said strip being in thermal contact with the underside of said foil, wherein the region of thermal contact between said thermally conductive strip and the foil is substantially linear and is transverse to the direction of movement of the recording paper.

DESCRIPTION OF THE PREFERRED EMBODIMENTS

The thermally conductive foil is preferably arranged to guide the recording paper through a curved path. This assists in ensuring adequate contact between the paper and the foil. Advantageously, the foil has a low thermal inertia, is resilient, and is able to conform to the movement of the recording paper. Generally, the foil will be in the form of a thin metallic strip; it is presently preferred to use a thin foil of a stainless steel. Other materials may, however, be used; examples include nickel, titanium and brass. In order to assist the conformation of the foil with the recording paper, the leading edge of the foil (with respect to the direction of advance of paper to be developed) is preferably free or loosely retained by, for example, a retaining lip. The trailing edge of the foil can be securely fixed to the recording apparatus if desired. A pressure pad may be used to hold the dry silver recording paper against the foil during development.

The thermally conductive strip preferably makes a knife edge contact with the underside of the thermally conductive foil. Although a variety of heating arrangements may be employed, a convenient arrangement is to employ a strip or wedge of material of high thermal conductivity onto one or both faces of which there is attached a printed circuit board heating element. A thin layer of an electrically insulating material may be placed between the heating element and the strip of material against which it is held. A polyimide film such as "KAPTON" (Registered Trade Mark) may be used for this purpose; Kapton film can be thin enough (e.g. 0.04 to 0.08 mm) to allow adequate thermal contact between the heating element and the strip while preventing any electrical connection therebetween. The thermal conduction properties of the assembly are improved if a thermally conductive material is applied between the heating elements and the Kapton films on the one hand, and between the edge of the thermally conductive strip and the thermally conductive foil on the other hand. A suitable material is sold as "Thermaflow type A30". It is important to ensure perfectly even application of such material, and this can be effected by use of a stencil to apply the material. Alternatively the Kapton and material can be replaced by the use of a self-adhesive, electrically insulating, thermally conductive tape such as that sold as "SIL-PAD 400" by Bergquist. Such a tape can be applied to the side faces and top edge of the thermally conductive strip.

Preferably, the heating element is arranged to provide a uniform temperature along the whole of the strip. To achieve this, it will generally be necessary to apply a greater heat input at the ends of the strip than elsewhere in order to compensate for the greater heat losses at these points. With identical printed circuit boards on opposite faces of the strip, it is possible to ensure that no stray electrical fields result from operation of the heating element. This is advantageous where, for example, a cathode ray oscilloscope forms part of the apparatus. The strip or wedge of material is preferably formed of copper. The edge of the strip can make direct contact with the thermally conductive foil. This edge of the strip is preferably about 1 millimeter wide.

In order to enable accurate control of temperature to be achieved, either (or both) of the heating elements preferably includes temperature sensing means, e.g. a thermocouple, the output of which is used to regulate the operation of the heating element. For example, the output of such a thermocouple can be fed into a low-drift, cold-junction compensated, differential amplifier whose output is in turn used to control the phase of a proportional heat-drive circuit. Such a circuit can be arranged to deliver full power until a predetermined temperature is reached, e.g. a temperature which is approximately 5° C. below the temperature required for a given operating speed, whereupon phase-proportional control comes into operation.

A developer unit in accordance with the present invention is very well suited to accurate development of dry silver recording papers at relatively low paper speeds. The developer is remarkable in that it enables 100:1 paper speed variation to be achieved with a fixed foil length of only 50 to 60 millimeters.

If it is desired to use relatively high paper speeds, e.g. upwards of 10 mm/sec, then a further embodiment of the invention may be used. This is generally similar to the arrangement already described except that it uses two thermally conductive strips each with associated heating elements. These strips can be placed a small distance apart beneath the thermally conductive foil.

BRIEF DESCRIPTION OF THE DRAWINGS

For a better understanding of the invention, and to show how the same may be carried into effect, reference will now be made, by way of example, to the accompanying drawings, which show one embodiment of the invention, and in which.

DETAILED DESCRIPTION OF THE DRAWINGS

Figure 3:
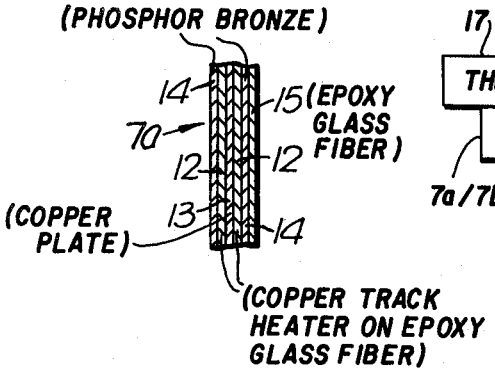
FIG. 3 is a schematic sectional view of one component shown in FIG. 2.

Referring to the drawings, the developer unit comprises a thin metallic foil 1 formed of a springy stainless steel two thousandths of an inch in thickness (0.05 mm). The steel is in accordance with BS 970, part 4 (1970) and is of type 302S25. The foil, by virtue of its material and its thickness, has low thermal inertia and is a good thermal conductor, particularly in the direction through (rather than along the surface of) the foil. The foil 1 is secured at one end thereof (as at 2) to a base board 3. The other end of the foil is held loosely by a retaining clip 4. Positioned midway along the foil and supporting the foil in an arcuate configuration is a thermally conductive strip 5 in the form of a strip of copper 0.9 mm in thickness. The area of contact 6 between the copper strip 5 and the stainless steel foil 1 therefore approximates to a knife edge contact. A thin layer of self-adhesive, electrically insulating, thermally conductive tape 11 is applied to the side faces and top edge of the strip 5. The tape is that known as "SIL-PAD 400". Identical printed circuit board heating element assemblies *7a* and *7b* are affixed on opposite sides of the copper strip 5, being separated from direct contact with the strip by the tape 11. As shown in FIG. 3, heating element assemblies comprise two copper-track elements etched on a strip of a high-temperature grade of epoxy glass fibre 12. The elements 12 are separated by a thin copper plate 13 and are sandwiched between two phosphor bronze strips 14. The inward facing surface of the assemblies is formed by a further strip 15 of epoxy glass fibre. The heating elements are arranged to deliver greater thermal energy at the ends of the strip to compensate for the increased thermal losses at these points, and include thermocouples connections which form part of a temperature control mechanism.

Figure 4:
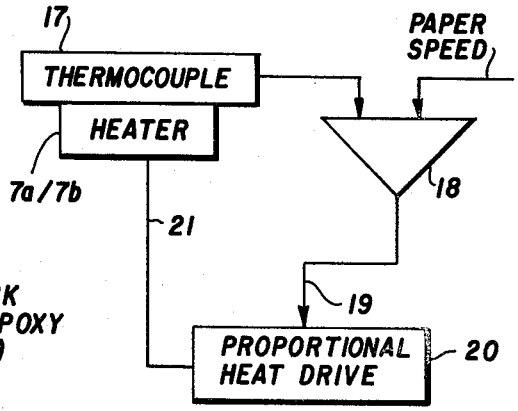
FIG. 4 illustrates schematically a temperature control mechanism.

FIG. 4 illustrates the temperature control mechanism. A thermocouple 17 associated with heating element *7a* (or *7b*) supplies current to a differential amplifier 18. A further input to the differential amplifier 18 is determined by the pre-selected paper speed (as shown in FIG. 4). The output 19 of the differential amplifier is fed to a proportional heat drive circuit 20 which controls the power supply via line 18 to the heating element *7a* (or *7b*).

Figure 1:
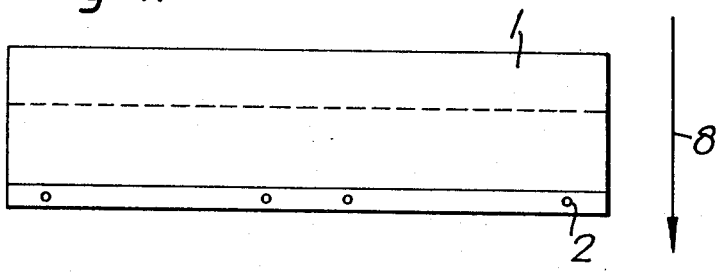
FIG. 1 is a diagrammatic plan view of the operative parts of the developer unit.
Figure 2:
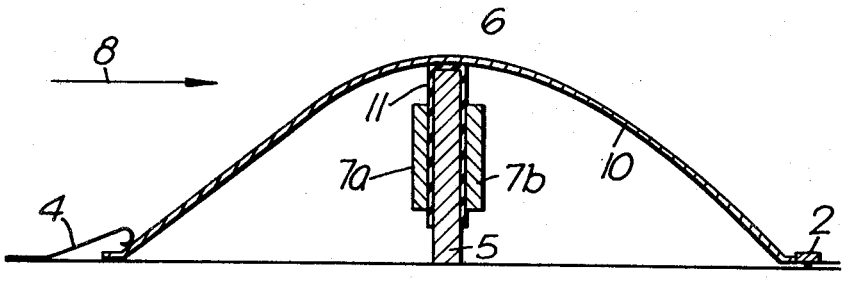
FIG. 2 is a diagrammatic cross-sectional view of the parts shown in FIG. 1 to a larger scale.

The configuration of the developer unit is such that the foil 1, if released from retaining clip 4, will spring upwardly away from the retaining clip 4 and away from copper strip 5 into a substantially flat configuration inclined to the base board 3 at an acute angle. The effective width of the foil (measured along the arc formed by the foil as shown in FIG. 2) is 50 mm. The copper strip 5 is 10 mm high. The strip 5 is positioned so that the area of contact 6 with the foil 1 is positioned exactly at the apex of the arc formed by the foil.

The developer unit may include one or two pressure pads (not shown) in the vicinity of area 6 in order to ensure good contact between foil 1 and paper which is being developed.

In use, an exposed dry silver recording paper (not shown) approaches the developer unit in the direction of arrow 8. The paper meets the foil 1 tangentially, and is guided over the foil to an outlet (not shown) from the recording apparatus. A pressure pad may be used to hold the paper in contact with the foil 1 at least over area 6 thereof. The paper speed is preferably in the range from about 0.1 mm/sec to 10 mm/sec, but speeds considerably greater than this—up to 100 mm/sec—may be achieved. The heating assemblies *7a* and *7b* generate heat which is conducted through copper strip 5 to the area of contact 6 between strip 5 and foil 1. The width of the strip 5 (0.9 mm) gives rise to a region centred on the part 6 of the foil 1 at which the temperature is a maximum. The region is approximately 2 mm wide as measured in the travelling direction of the recording paper. The thermal conductivity of the foil 1 provides a preheating area 9 and a cooling area 10 on either side of the region of maximum temperature. The heating assemblies *7a* and *7b* are controllable as described above to provide a maximum temperature at 6 which will ensure adequate development of the recording paper at the paper speed in operation. Since the heating assemblies *7a* and *7b* are identical, any stray electrical fields which might have been produced by a single board will effectively be cancelled out. The springy nature of the stainless steel foil 1 enables it to conform to the shape of the recording paper as the paper passes over the foil 1. This ensures good thermal contact between the paper and the foil. The pre-heating zone 9 provides a steady temperature gradient along the path followed by the recording paper, and prevents creasing or crinkling of the paper at the point where the developing temperature is at a maximum.

By using a developer unit as described above, it has been possible to develop dry silver recording papers to maximum contrast without any discoloration of the recording over a range of paper speeds from 0.1 to 10 mm/sec.

The length of the foil 1 and of the copper strip 5 corresponds to the width of recording paper which is to pass over the foil. In the embodiment illustrated, the paper width was 230 mm.

I claim:

1. A developer unit apparatus for dry silver recording paper, which comprises a thin foil of thermally conductive material over the top surface of which the recording paper is passed; and a thermally conductive strip provided with at least one heating element, said strip being in thermal contact with the underside of said foil, wherein the region of thermal contact between said thermally conductive strip and the foil is substantially linear and is transverse to the direction of movement of the recording paper, wherein heating assemblies each including at least one heating element are provided on opposite faces of said thermally conductive strip, and wherein each heating assembly comprises two copper-track elements etched on a strip of epoxy glass fibre, said elements being separated by a thin copper plate and being sandwiched between two phosphor bronze strips.

2. A developer unit apparatus for dry silver recording paper, which comprises a thin foil of thermally conductive material over the top surface of which the recording paper is passed; and a thermally conductive strip provided with at least one heating element, said strip being in thermal contact with the underside of said foil, wherein the region of thermal contact between said thermally conductive strip and the foil is substantially linear and is transverse to the direction of movement of the recording paper, wherein heating assemblies each including at least one heating element are provided on opposite faces of said thermally conductive strip, wherein each heating assembly comprises two copper-track elements etched on a strip of epoxy glass fibre, said elements being separated by a thin copper plate and being sandwiched between two phosphor bronze strips, and wherein an inward facing surface of each of the heating assemblies is formed by a further strip of epoxy glass fibre.

3. A developer unit for dry silver recording paper, which comprises a thin foil of thermally conductive material having a curved profile and being arranged to guide said recording paper over its top surface through a curved path; and a thermally conductive strip held in thermal contact with the underside of said foil, the region of thermal contact between said thermally conductive strip and said foil being substantially linear and transverse to the direction of movement of the recording paper, wherein heating assemblies each including at least one heating element are provided on opposite faces of said thermally conductive strip, each heating assembly comprising two copper-track elements etched on a strip of epoxy glass fibre, said elements being separated by a thin copper plate and being sandwiched between two phosphor bronze strips.

4. A developer unit apparatus for dry silver recording paper, which comprises a thin foil of thermally conductive material rigidly secured at one end thereof to a support surface, said foil being of curved profile and arranged to guide said recording paper over its top surface through a curved path; and a thermally conductive strip provided with at least one heating element, said strip being located between said support surface and the underside of said foil and being in thermal contact with the underside of said foil, the region of thermal contact between said thermally conductive strip and the foil being substantially linear and transverse to the direction of movement of the recording paper.

5. Apparatus as claimed in claim 4, wherein the thermally conductive foil is in the form of a thin metallic strip.

6. Apparatus as claimed in claim 5, wherein said thin metallic strip is formed of a stainless steel.

7. Apparatus as claimed in claim 1, wherein the thermally conductive strip makes a knife edge contact with the underside of the thermally conductive foil.

8. Apparatus as claimed in claim 1, wherein said thermally conductive strip is formed of copper.

9. Apparatus as claimed in claim 1, wherein heating assemblies each including at least one heating element are provided on opposite faces of said thermally conductive strip.

10. Apparatus as claimed in claim 9, wherein the thermally conductive strip has respective ends, and the heating elements are arranged to deliver greater thermal energy at the ends of the thermally conductive strip in order to compensate for the increased thermal losses at these points.

11. Apparatus as claimed in claim 9, wherein the heating assemblies include a thermocouple which forms part of a temperature control mechanism.

12. Apparatus as claimed in claim 11, wherein said thermocouple is arranged to provide current to a differential amplifier, the output of which is delivered to a proportional heat drive circuit which controls the power supply to the heating element of the heating assembly.

13. Apparatus as claimed in claim 9, wherein an electrically insulating, thermally conductive tape is applied between the thermally conductive strip and each of the heating assemblies.

14. Apparatus as claimed in claim 13, wherein said tape is self-adhesive.

* * * * *